United States Patent [19]

Towns et al.

[11] Patent Number: 4,793,505

[45] Date of Patent: Dec. 27, 1988

[54] TAMPER-INDICATING CONTAINER CLOSURE WITH RUPTURABLE DISK

[75] Inventors: Edward J. Towns, Convent Station; Edward M. Brown, Livingston, both of N.J.; William M. Lester, Del Ray Beach, Fla.

[73] Assignee: TBL Development Corporation, Livingston, N.J.

[21] Appl. No.: 462,085

[22] Filed: Jan. 28, 1983

Related U.S. Application Data

[63] Continuation-in-part of Ser. No. 443,608, Nov. 22, 1982.

[51] Int. Cl.[4] ..... B65D 53/04

[52] U.S. Cl. ..... 215/250; 215/350; 215/DIG. 1; 220/214

[58] Field of Search ..... 215/203, 209, 211, 213, 215/214, 218, 219, 220, 230, 232, 250, 251, 252, 253, 254, 257, 258, 341, 343, 344, 347, 349, 350, 351, 329, 348, 366, 247, DIG. 1; 220/214, 254, 258, 304, 359

[56] References Cited

U.S. PATENT DOCUMENTS

| | | | |
|---|---|---|---|
| 603,151 | 4/1898 | Norton . | |
| 810,334 | 1/1906 | Green . | |
| 939,602 | 11/1909 | Landon . | |
| 1,095,313 | 5/1914 | Davids . | |
| 1,916,977 | 7/1933 | Gutmann | 215/329 X |
| 2,068,389 | 1/1937 | Smith | 215/350 |
| 2,090,555 | 8/1937 | Sharp . | |
| 2,131,774 | 10/1938 | Waring | 215/250 |
| 2,131,775 | 10/1938 | Waring | 215/250 |
| 2,560,793 | 7/1951 | Greene | 215/252 |
| 3,074,579 | 1/1963 | Miller | 215/DIG. 1 |
| 3,489,307 | 1/1970 | Wenger | 215/351 X |
| 3,501,042 | 3/1970 | Risch et al. | 215/232 |
| 3,826,221 | 7/1974 | Ross . | |
| 3,899,295 | 8/1975 | Halpern . | |
| 3,923,198 | 12/1975 | Brochman . | |
| 4,381,840 | 5/1983 | Ostrowsky | 215/329 |
| 4,456,139 | 6/1984 | Kent | 215/252 |
| 4,461,389 | 7/1984 | Korn | 215/246 |

FOREIGN PATENT DOCUMENTS

| | | | |
|---|---|---|---|
| 552737 | 12/1956 | Belgium | 215/DIG. 1 |

*Primary Examiner*—Stephen Marcus
*Assistant Examiner*—Bryon Gehman
*Attorney, Agent, or Firm*—Robin, Blecker & Daley

[57] ABSTRACT

A container closure includes a cap having depending interior tines in engagement with a tamper-indicating element and thereby moving the element into registry with a container access port. Load-sharing structure is incorporated in the cap to provide additive force for movement of the tamper-indicating element, such force being imposed on the element at a location spaced from the location of engagement of the tines and the element. The load-sharing structure may also provide for sealably reclosing the container upon opening of the closure and removal of the tamper-indicating element.

6 Claims, 3 Drawing Sheets

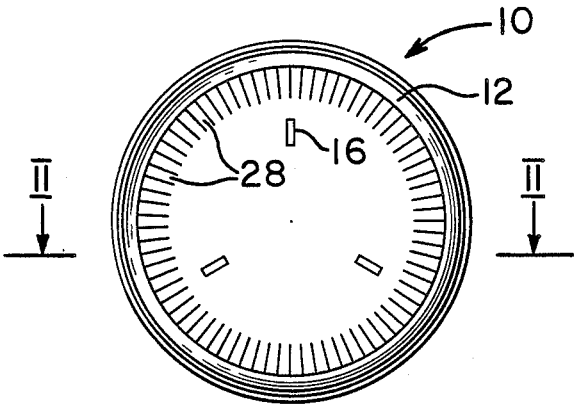
FIG. 1
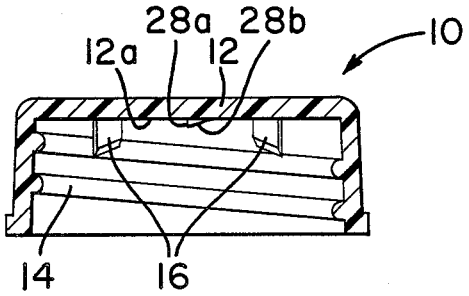
FIG. 2
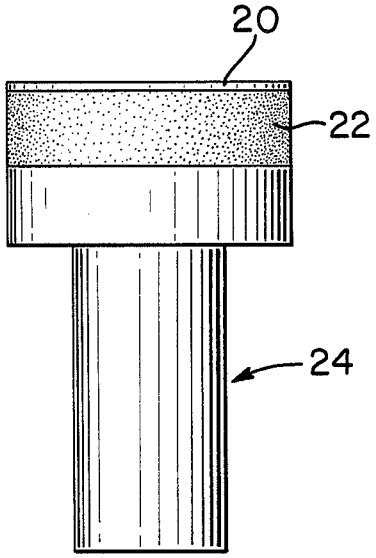
FIG. 3
FIG. 4
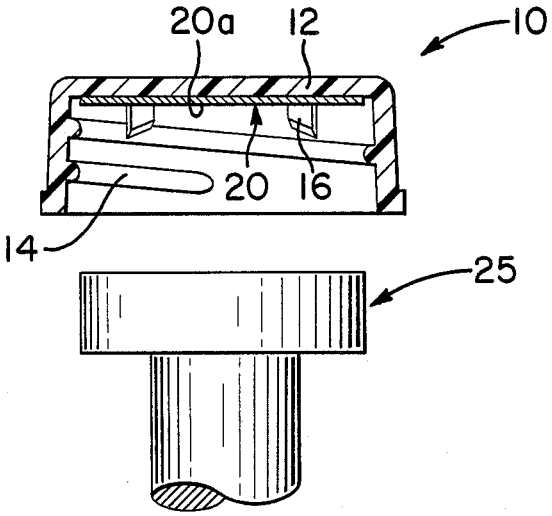
FIG. 5
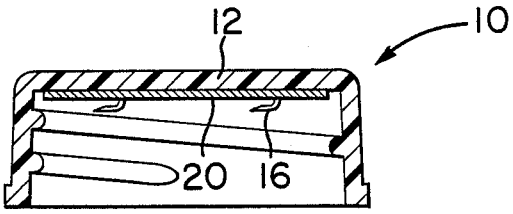
FIG. 6
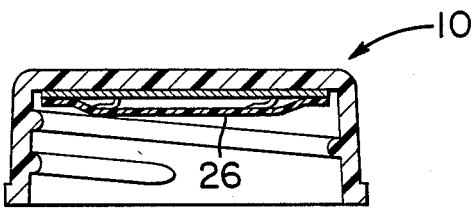
FIG. 7

TAMPER-INDICATING CONTAINER CLOSURE WITH RUPTURABLE DISK

CROSS-REFERENCE TO RELATED APPLICATION

This application is a continuation-in-part of U.S. patent application Ser. No. 443,608, filed on Nov. 22, 1982 and entitled "Tamper-Indicating Closure for a Container, Container and Method for Making Same" of applicants herein.

FIELD OF THE INVENTION

This invention relates generally to containers and closures of tamper-indicating type and pertains more particularly to closures adapted for enhanced movement of tamper-indicating elements therewith and having container sealing capability upon opening of the container and removal of the tamper-indicating element.

BACKGROUND OF THE INVENTION

In U.S. patent applications Ser. No. 441,109 filed on Nov. 12, 1982, Ser. No. 443,608 filed on Nov. 22, 1982 and Ser. No. 450,531 filed on Dec. 17, 1982, all commonly-assigned herewith, a tamper-indicating system is disclosed wherein a cap or other closure member for a container is equipped with interior means movable with the cap and adapted to secure a telltale to the cap for movement therewith. Such movable means selectively tear the telltale, i.e., when it is further secured to the container, thereby to render visible through the cap an indication advising the container purchaser if effort had theretofore been made to remove the cap from secured relation to the container.

In preferred arrangement, one such system includes a tine or tines depending from the cap upper interior surface and comprising such means movable with cap and the tines are resident in a foam layer of a multilayer telltale indicator also including a foil layer through which the tines also extend and an underlayer of dense paper, such paper underlayer being in sealing relation to the container access port. The paper layer includes a tamper-indicating indicium on its surface in facing relation to the foam layer and the paper layer integrity is unaffected by the tines as they move with the cap opening sense movement to tear the foam and render the indicium visible. Typically, the foam is of white color and the indicium is of red color and the cap opening sense movement gives rise to an increasingly displayed red warning in the white background for indicating initial opening of the container.

In other embodiments, the telltale indicator may comprise a single layer of sheet material which is piercingly engaged by the tines and securable to the container access port, again to be torn upon opening sense cap movement.

SUMMARY OF THE INVENTION

The present invention has as its objects the provision of improved closures for use in practice of the inventions of the above-referenced commonly-assigned patent applications, particularly in adapting same for use with delicate telltale structure and for providing container sealing capability in the closure upon opening of the container and removal of the tamper-indicating element.

In attaining this and other objects, the invention provides closures having closure members with means for lessening the likelihood of telltale rupture by tines during assembly of the closure with a container. To this end, such means preferably take the form of structure within the closure member and non-activatingly engagable with the telltale for imposing moving force thereon, at telltale locations remote from the tine-telltale interface, in the course of movement of the closure with telltale in place therein.

In one embodiment, such force imposing means comprises a plurality of radially extending ribs integrally formed in the interior undersurface of the closure member at the periphery thereof, the ribs having downwardly extending vertical rises and ramps trailing from the apex of each rise to the closure member undersurface, the ribs facingly engaging the the upper surface of the telltale and imparting force thereto on closure member closing sense movement relative to a container.

In another embodiment, the force imposing means comprises an annular element non-integral with the closure member and secured thereto for frictionally engaging the periphery of the telltale at its upper surface and imparting force thereto in the course of closure member movement relative to a container. In this embodiment, upon opening of the container and removal of the telltale, the force imposing means functions as a seal upon reclosure of the container.

The foregoing and other objects and features of the invention will be further understood from the following detailed description of preferred embodiments of closures thereof and from the drawings wherein like reference numerals are used throughout to identify like parts.

SUMMARY OF THE DRAWINGS

FIG. 1 is a plan elevation of one closure member embodiment with integral force imposing members in accordance with the invention.

FIG. 2 is a sectional view of the FIG. 1 closure member as would be seen from plane II—II of FIG. 1.

FIG. 3 shows a telltale supported on an assembly tool.

FIG. 4 is a sectional view of the FIG. 1 closure member from the FIG. 2 perspective with a telltale assembled therewith.

FIG. 5 shows a tine working tool.

FIG. 6 is a sectional view of the FIG. 1 closure member with the tines worked by the FIG. 5 tool.

FIG. 7 is a sectional view of the FIG. 1 closure member further assembled with a container access port sealing layer.

DESCRIPTION OF PREFERRED EMBODIMENTS AND PRACTICES

Figure 8:
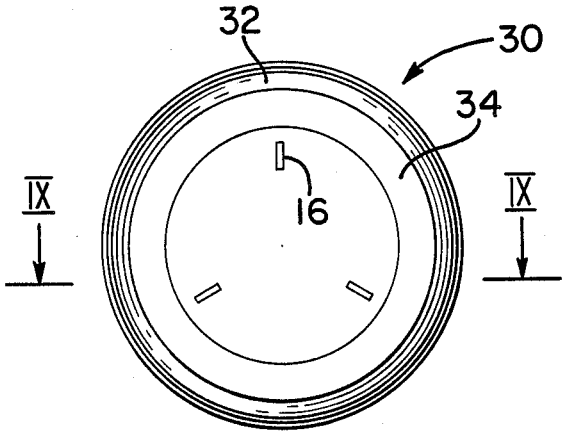
FIG. 8 is a plan elevation of a further closure member embodiment with a non-integral force imposing member in accordance with the invention.
Figure 9:
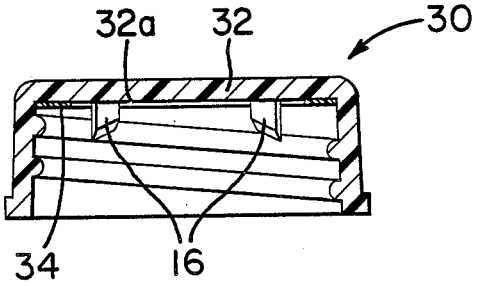
FIG. 9 is a sectional view of the FIG. 8 closure member as would be seen from plane IX—IX of FIG. 8.
Figure 11:
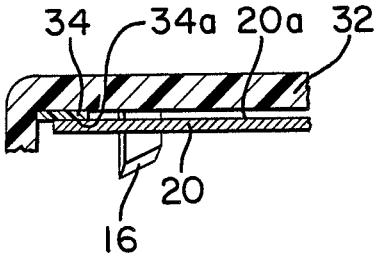
FIG. 11 is an enlarged partial sectional view of the FIG. 10 assembly.
Figure 10:
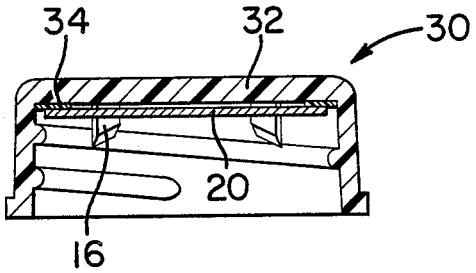
FIG. 10 is a sectional view of the FIG. 8 closure member from the FIG. 9 perspective with a telltale assembled therewith, the telltale and force imposing member being shown without sectioning.

Referring to FIGS. 1 and 2, closure 10 includes cap or closure member 12, having interior threads 14 for securement to a container and including tines 16 extending downwardly from the cap upper interior surface 12*a* and disposed within the cap container closing expanse. Tines 16, which may be one or more in number, are shown arranged as three puncturing elements spaced at equal angles. Each tine may be formed integrally with cap 12, e.g., is molded therewith, and is rigid, such that it is not readily deflectable relative to cap undersurface 12*a*. Based on its secured relation to cap 12, each tine travels with the cap in the course of its first sense (clockwise) movement into releasably secured relation with container or jar 18 (FIG. 12) and also in the course of second opposite (counterclockwise) sense cap movement relative to the jar for release from secured relation therewith. It will also be observed that tine 16 is radially offset from the center of the rotative movements of cap 12 and that the tine extends generally parallel to the axis of the hollow cylindrical cap. The tine is disposed radially of the rotation center, thus presenting its primary extent extending generally radially to provide a frontal expanse for rupture or tearing of indicating element or telltale 20 (FIG. 3).

Telltale 20, which may be paper sheet material, having particular capabilities discussed below, is secured to tines 16, which pierce through the telltale as it is forced thereover into the cap interior. In such assembly, the telltale is placed upon compressible upper portion 22 of assembly tool 24 and the tool is forced into the cap. While telltale 20 is retained on tines 16 by their piercing thereof, as is shown in FIG. 4, assembly practice now makes use of a tine staking tool, such as is indicated by reference numeral 25 in FIG. 5. Tool 25 is displaced into the hollow of cap and into engagement with tines 16. There results the preassembly shown in FIG. 6, wherein the tine ends return in generally arcuate course into flat non-tearing disposition to undersurface 20*a* of telltale 20.

The step just described has benefit in enhancing the retention of telltale 20 in cap 12 and in enhancing the tearing thereof. Further, the step places the preassembly attained thereby in such posture that it may now receive an underlayer, as part of the cap as manufactured, having its integrity unaffected by activation of the telltale. Thus, with the tine ends now not having their prior puncturing and tearing capability below the telltale, jar mouth or container access port sealing layer 26 is secured to the FIG. 6 preassembly at margins of member 20, as is indicated in FIG. 7, by interposed adhesive or other bonding.

Tines 16 are movable with cap 12, preferably being formed integrally therewith, and telltale 20 is movable by the tines with the cap as the cap is secured to a container. The cap is of see-through character, being of suitable translucent plastic or the like, such that the state of telltale 20 is visible through the cap.

An adhesive may be applied either to the mouth of a container or to the undersurface of layer 26, such that, upon securement of the closure to the jar by engagement of cap threads 14 with container neck threads layer 26 becomes secured to the container and hence telltale 20 is rendered fixed relative to the container. As discussed above and in full detail in the referenced commonly-assigned patent applications, gripping of the closure and counterclockwise rotation thereof effects a tearing of telltale 20 and indicates initial opening of the container.

Where telltale 20 is in the configuration of a laminate or multilayer indicating-element, as in the patent application Ser. No. 450,531 above-referred to, i.e., including an upper foil member of highly tearable nature, or in the form of FIGS. 1–7 and of delicate sheet material, again quite readily tearable, practice as above discussed can present difficulty in assembly, particularly as the assembly of FIG. 7 is rotated into securement with a container. Thus, tines 16 and more particularly the frontal radial expanses thereof above noted, are alone in force-imposing relation to the telltale and alone carry it into desired position in the final assembly. In such cap closing sense movement, a point is reached at which the assembly of FIG. 7 is compressed between the cap and container, and at that juncture, resistance to further rotation is met. In overcoming such resistance, increased force is applied to the cap and transmitted through the tines to the delicate telltale, heightening the tendency for movement of the cap and tines relative to the telltale and at times tearing the telltale and rendering it ineffective for use.

In accordance with the present invention, means are introduced in the closure for imposing force on the telltale at locations other than the tine-telltale interface, such introduced force being supportive of the tine-applied force and, in effect, load sharing therewith. In the FIG. 1 embodiment, cap 12 has formed integrally therein radially extending ribs 28, disposed outboard of tines 16 and at the interior periphery of cap 12. The ribs have generally vertical rises 28*a* at their cap clockwise sides, the rises extending downwardly from cap undersurface 12*a*, as is seen in FIG. 2 for the single such rib illustratively shown. The ribs have trailing ramps 28*b* at their cap counterclockwise sides. With this arrangement, the cap closing sense rotative movement is accompanied by forceful engagement of rises 28*a* with telltale element 20 at its upper surface along with the tines, effectively distributing the force applied to the telltale element and permitting use of delicate tamper-indicating elements as telltales, e.g., foils, thin paper and the like. In reverse rotation, i.e., cap opening sense movement, the ramps ride over the telltale surface, and tearing is effected by the tines.

Figure 12:
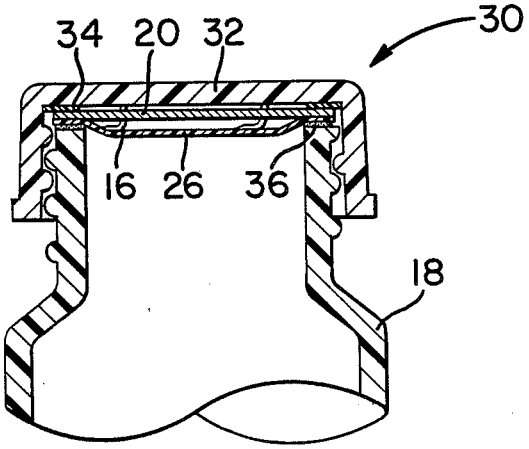
FIG. 12 is a sectional view of a closed container inclusive of the FIG. 10 closure member.

In the embodiment of force imposing/distributing means shown in FIGS. 8–12 in accordance with the invention, closure 30 includes cap or closure member 32 in which the radial ribs of the first embodiment are not introduced. Here, a force imposing member 34 is secured in the cap interior, adjacent cap undersurface 32*a*, and is preferably in the form of a ring in circumscribing non-interfering relation to tines 16. Member 34 is selected to be of plastic composition which is more compressible than the plastic material constituting cap 32 and is also selected, relative to telltale 20, to impart frictional force to the telltale upper surface upon compression of member 34 between cap 32 and telltale 20. The telltale is inserted in the cap to provide the assembly of FIG. 10 by use of the tool of FIG. 3 and the tines are staked as above discussed by use of the FIG. 5 tool to provide the closure of FIG. 12, shown in secured engagement with jar 18. As will be seen from the sectional enlargement of FIG. 11, the undersurface 34*a* of member 34 is in force imposing/distributing relation with upper surface 20*a* of the telltale in the course of assembly reaching FIG. 12, wherein adhesive 36 secures the closure to the jar access port.

In this embodiment, upon initial opening of the FIG. 12 container, one may remove the torn telltale from the closure and remove layer 28 from the container to gain access to the contents of the container, but may reseal the container by virtue of the remaining presence of member 34 in the closure and its characteristic compressibility adapted also for direct sealing engagement of undersurface 34*a* with the container adjacent its access port.

Various changes in structure and modifications in practice may evidently be introduced in the foregoing without departing from the invention. For example, while the drawings depict telltale insertion and tine working with the cap in upright position, mechanized practice would involve practice of these steps with the cap inverted from its illustrated disposition. Further, while member 34 is shown as an insert to the cap, the invention also contemplates forming such member in the cap, e.g., by solidifying a liquid plastic introduced in the cap. Acccordingly, the particularly described and depicted embodiments and practices are intended in an illustrative and not in a limiting sense. The true spirit and scope of the invention is set forth in the following claims.

We claim:

1. A tamper-indicating closure for a container comprising:

(a) a see-through closure member defining container closing expanse and including means for rotation of said closure member in container closing and opening senses;

(b) means disposed interiorly of said closure member expanse for movement with said closure member;

(c) a tamper-indicating element in said closure member in engagement with said means (b) to be activated thereby upon opening sense closure member rotation; and (d) means secured to said closure member for movement therewith and movable relative to said tamper-indicating element, such secured means being situated between said tamper-indicating element and said closure member closing expanse and adapted to engage said tamper-indicating element (1) to impart a given force to said tamper-indicating element at a location thereon distal from the location of engagement of said tamper-indicating element and said means (b), thereby to displace said tamper-indicating element jointly with displacement thereof by said means (b) in the course of said closure member container closing sense movement and (2) to rotate relative to said tamper-indicating element in the course of said closure member opening sense movement, said secured means further defining a container access port sealing surface upon removal of said tamper-indicating element from said closure.

2. The closure claimed in claim 1 wherein said secured means surface also constitutes a surface for such imparting of force to said tamper-indicating element.

3. The closure claimed in claim 2 wherein said secured means comprises a sealing and force imposing member of material having compressibility greater than the material constituting said closure member.

4. The closure claimed in claim 1 wherein said secured means comprises a plurality of ribs having rises generally perpendicular to said tamper-indicating element.

5. The closure claimed in claim 4 wherein said ribs further include ramps extending from said rises to the undersurface of said closure member.

6. The closure claimed in claim 1 wherein such secured means is integral with said closure member.

* * * * *